United States Patent [19]

Isaksson

Best Available Copy

[11] 4,309,568

[45] Jan. 5, 1982

[54] BUSHING FOR ELECTRICAL LEADS

[75] Inventor: Sven-Erik Isaksson, Robertsfors, Sweden

[73] Assignee: ASEA Aktiebolag, Vesteras, Sweden

[21] Appl. No.: 865,683

[22] Filed: Dec. 29, 1977

[30] Foreign Application Priority Data

Jan. 21, 1977 [SE] Sweden ..... 7700615

[51] Int. Cl.[3] ..... H01B 17/30

[52] U.S. Cl. ..... 174/151; 174/18; 174/65SS; 277/125

[58] Field of Search ..... 174/151, 18, 23 R, 65 SS, 174/77 R, 152 R; 277/4, 102, 105–108, 110–112, 114, 123, 125

[56] References Cited

U.S. PATENT DOCUMENTS 965,684 7/1910 Bierce et al. ..... 174/77 R X
2,361,215 10/1944 Lamberger et al. ..... 174/65 SS X
2,856,452 10/1958 Appleton et al. ..... 174/77 R
2,964,437 12/1960 Appleton et al. ..... 174/77 R X
3,290,427 12/1966 Newcomer ..... 174/65 SS

FOREIGN PATENT DOCUMENTS 450236 4/1975 U.S.S.R. ..... 174/18

*Primary Examiner*—Laramie E. Askin
*Attorney, Agent, or Firm*—Watson, Cole, Grindle & Watson

[57] ABSTRACT

An electrical bushing is provided to facilitate the passage of electrical conductor leads from thermocouples or the like through a pressure barrier. The bushing includes a casing and a deformable, resilient, elastic plug which is disposed in a central conductor receiving bore of the casing in surrounding relationship to the conductors. Thus, when the plug is compressed in a direction axially of the casing, the plug tends to expand laterally radially and into sealing contact with the internal surfaces of the bore and with the electrical conductors.

3 Claims, 3 Drawing Figures

BUSHING FOR ELECTRICAL LEADS

BACKGROUND OF THE INVENTION

1. Field of the Invention

The present invention relates to an electrical bushing that is particularly useful for facilitating the passage of a plurality of signal leads or conductors from thermocouples or the like through a pressure barrier or wall defining the pressure chamber which surrounds the furnace space in a pressure furnace of the kind which is used for treatment of workpieces at high temperatures and simultaneously at high pressures. The furnace may, for example, be of the type which is described in greater detail in U.S. Pat. No. 3,790,339.

2. Description Of The Prior Art

Bushings of the type to which the present invention relates generally comprise an elongated bushing casing which is inserted into a bored recess or opening extending through a pressure barrier such as the end closure for a pressure vessel. Typically the casing is provided with a shoulder formed between two adjacent portions or lengths having different diameters. The shoulder on the casing abuts against a similarly formed shoulder in the bored recess to thereby establish and fix the positioning of the bushing in the opening and relative to the pressure barrier. The bushing unit is generally intended for accommodation of a large number of conductors.

In known bushings, the conductors are cast into long holes in, for example, polystyrene core elements which are then polymerized further to obtain a sufficient strength to resist the applied pressure differential. In other known bushings the conductors are cast into a joint made of a thermosetting resin, such as, for example, an epoxy resin, in a gap provided in the joint between a conical wall in a hole and a conical plug. In these known bushings it has been practically impossible to remove the conductors for insertion of new ones after the bushing is once installed. Thus, from the point of view of maintenance and service, these prior bushings are less suited for commercial operation on an industrial scale where, of course, the easy performance of service and maintenance operations is of vital importance.

SUMMARY OF THE INVENTION

The problems, difficulties and short-comings experienced with prior art bushings are minimized, if not eliminated completely, by the provision, in accordance with the present invention, of an electrical bushing for facilitating the passage of elongated conductor leads or elements through a pressure barrier comprising an elongated bushing casing adapted for longitudinal insertion in an opening extending through a pressure barrier and having shoulder means thereon adapted for abutment against corresponding shoulder means in said opening to thereby establish and fix the positioning of the casing in the opening relative to the barrier. The casing has a centrally disposed bore extending longitudinally therethrough from one end thereof that is intended for placement at the high pressure side of said barrier and terminating in said casing at a point between the ends of the latter thereby presenting a bottom for the bore which normally faces toward said high pressure side of the barrier when the casing is inserted in the opening. The casing also has a plurality of individual bore holes extending longitudinally through the casing from the other end thereof that is intended for placement on the low pressure side of the barrier, through said bottom and into communication with said bore. These bore holes each are of sufficient diameter to accommodate an insulated conductor element therein. The bushing also includes an insulator plate disposed in said bore on said bottom and presenting an upper surface facing in the same direction as said bottom. This plate has a plurality of individual bore holes extending therethrough in a direction longitudinally of the casing from said bottom and through said surface, there being a corresponding bore hole in said plate for each of the bore holes of the casing. The corresponding bore holes of the plate and of the casing are disposed in longitudinal alignment and the bore holes of the plate each have a first length adjacent said surface which is smaller in diameter than the remaining length thereof. These remaining lengths each have a diameter which is substantially the same as the diameter of the corresponding bore hole of the casing for accommodating an insulated conductor element therein and the first lengths each have a diameter suitable for accommodating an uninsulated conductor element therein. The bushing further includes a deformable, resilient, elastic plug disposed in said bore on said surface of the plate. This plug has a shape and size for sealingly contacting the inner peripheral surface of said bore adjacent said surface of the plate and the same is adapted for having uninsulated conductor elements inserted therethrough in a manner such that the material of the plug is in contact with the elements. Thus, when said plug is forced toward said plate, the plug tends to expand laterally and into sealing contact with respect to said peripheral surface and the conductor elements inserted through the plug.

The bushing of the present invention may also include means for forcing the plug toward said plate.

DETAILED DESCRIPTION OF THE INVENTION

Figure 1:
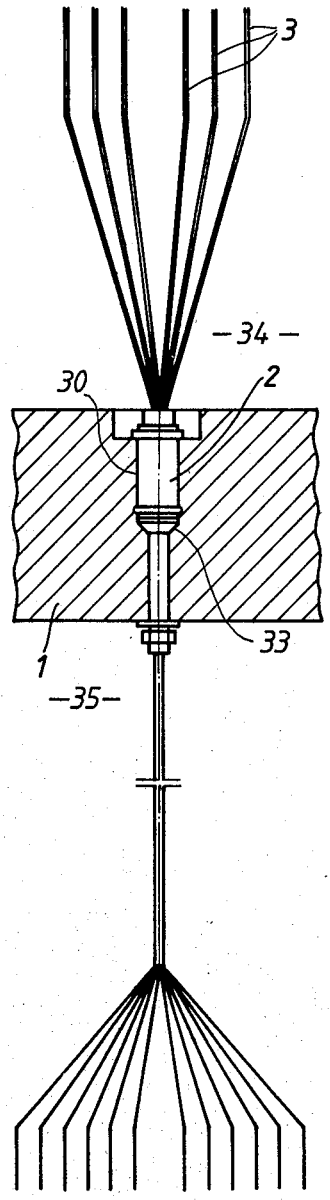
FIG. 1 is a schematic view illustrating a bushing which embodies the concepts and principles of the present invention inserted in an opening that extends through a pressure barrier.
Figure 2:
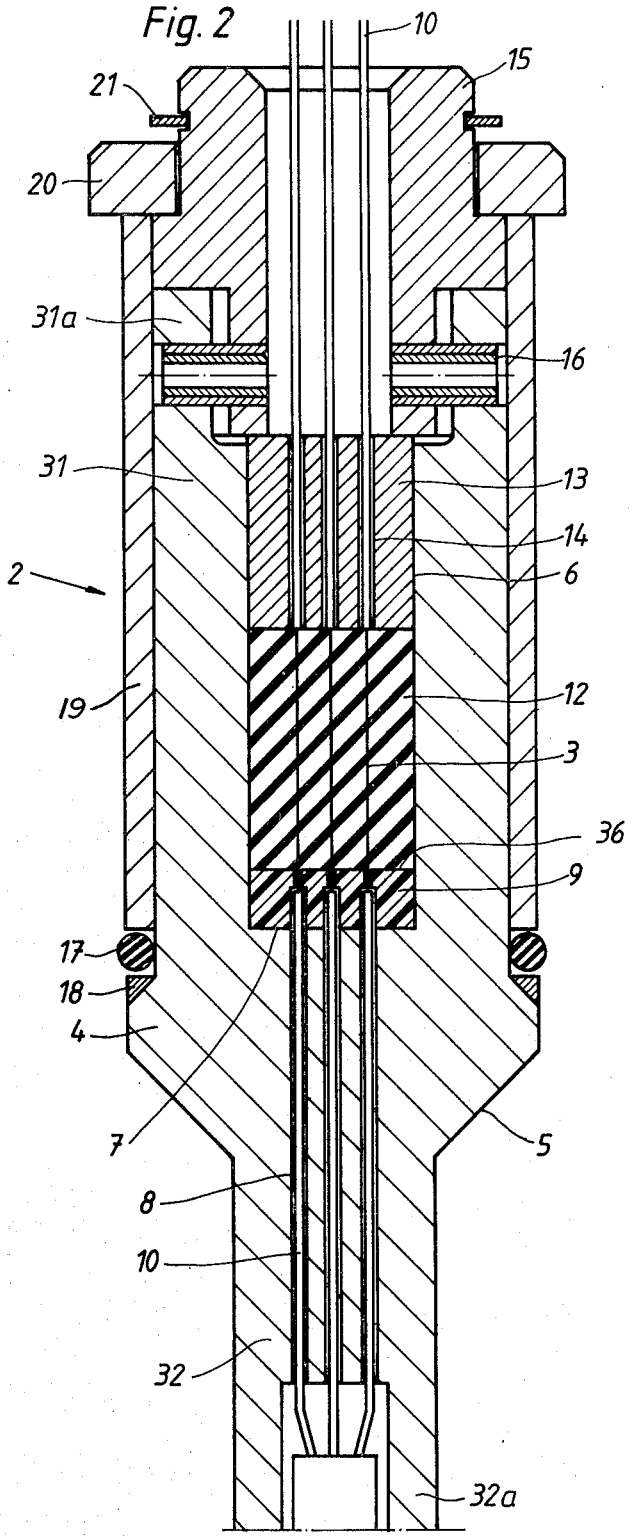
FIG. 2 is a cross-sectional view on a larger scale illustrating certain internal and external details of the bushing of FIG. 1.
Figure 3:
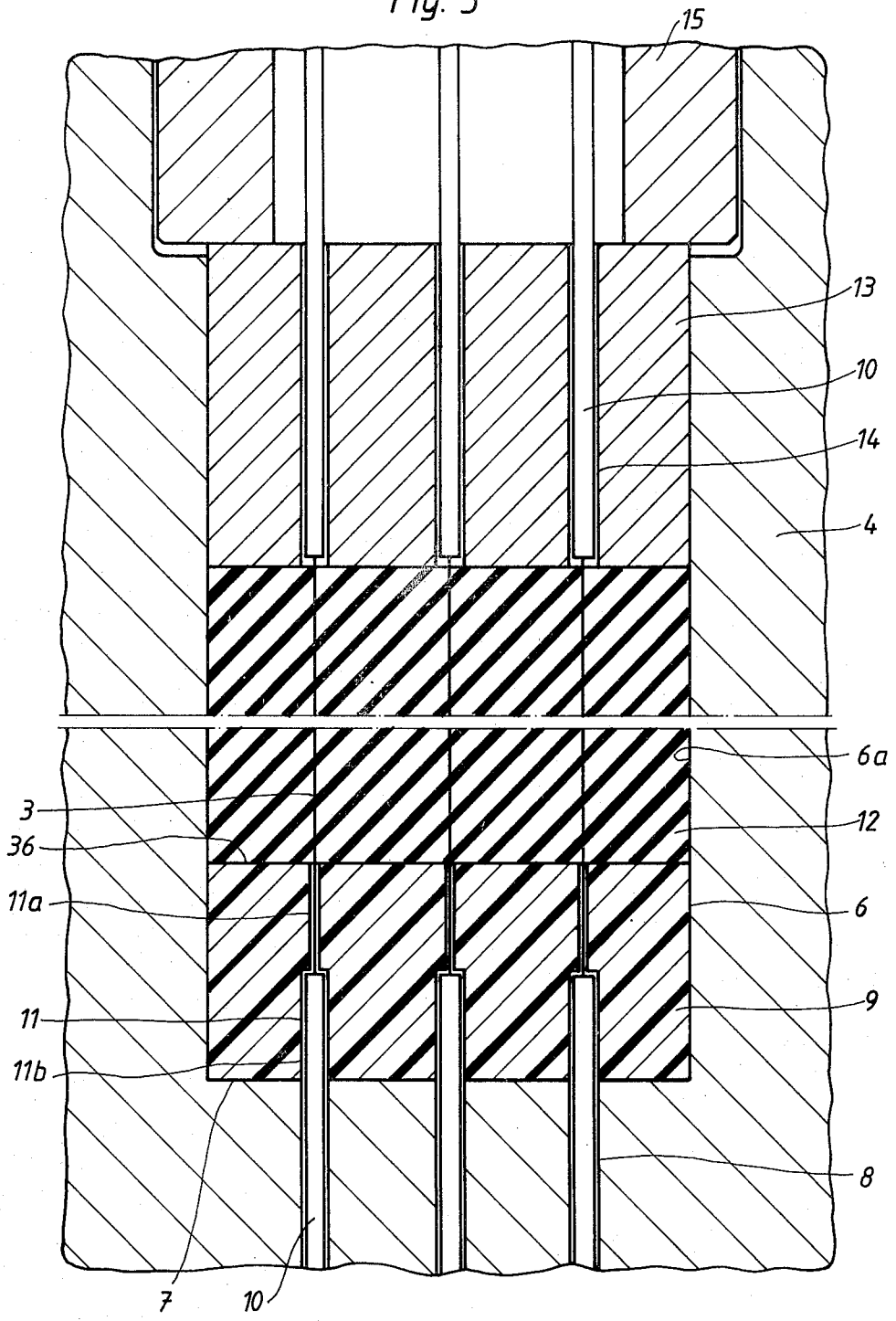
FIG. 3 is a cross-sectional, fragmentary view on yet a larger scale of a portion of the bushing of FIGS. 1 and 2.

With reference to FIGS. 1, 2 and 3, an electrical bushing 2 constructed in accordance with the principles and concepts of the present invention is adapted for insertion in an opening 30 that extends through a pressure barrier 1 which may be, for example, the end closure for the pressure chamber of a high pressure furnace. As shown, it it intended that the bushing 2 be adapted to accommodate a plurality of signal conductor elements or leads 3 and to facilitate the passage of elements 3 through the barrier 1.

Bushing 2 preferably comprises an elongated steel casing 4 having a conical transition portion 5 disposed between the larger diameter portion 31 of casing 4 and its smaller diameter portion 32. Casing 4 is adapted for longitudinal insertion into opening 30 as shown in FIG. 1 with its portion 5 presenting an annular shoulder which abuts against a corresponding shoulder 33 formed in opening 30. The abutment of shoulders 5 and 33 establishes and fixes the positioning of casing 4 in opening 30 and relative to barrier 1. In this connection it should be noted that the larger diameter portion 31 of casing 4 extends toward the high pressure side 34 of barrier 1 while the smaller diameter portion 32 of casing 4 extends toward the low pressure side 35 of barrier 1.

Casing 4 is provided with a centrally disposed bore 6 extending longitudinally through portion 31 of casing 4 from the end 31*a* thereof that is normally intended for placement at the inner high pressure side 34 of pressure barrier 1. Bore 6 terminates at a bottom 7 which may be planar, which is disposed between end 31*a* of casing 4 and the opposite end 32*a* and which normally faces high pressure side 34 when bushing 2 is inserted in opening 30. In this regard it should be appreciated that end 32*a* is normally intended for placement at the outer, low pressure side 35 of barrier 1.

Bushing 2 further includes a plurality of individual bore holes 8 which each extend longitudinally through casing 4 from end 32 and toward and through bottom 7, thus opening into bore 6. A conductor element 3 normally extends through each bore hole 8 and as shown in FIGS. 2 and 3, the elements 3 are insulated with an insulating tube 10 at the portions thereof disposed in holes 8. Manifestly, hole 8 must be of sufficient diameter to accommodate the insulated conductor elements 3. The insulation 10 may simply comprise lengths of hose disposed in surrounding relationship to conductors 3.

An insulator plate 9 is constructed, for example, of an insulating plastic material of high strength, such as polyamide or nylon. Plate 9 is disposed in bore 6 on bottom 7 and has an upper surface 36 which normally faces high pressure side 34 when bushing 2 is installed in barrier 1. Thus, surface 36 faces in the same direction as bottom 7. As can best be seen in FIG. 3, plate 9 is provided with a plurality of individual bore holes 11 which extend therethrough in a direction longitudinally of casing 4 from bottom 7 and through surface 36. As shown, there is a corresponding bore hole 11 in plate 9 for each of the bore holes 8 of casing 4, and the pairs of corresponding holes 11 and 8 are longitudinally aligned. Conductor elements 3 from bore holes 8 extend through bore holes 11.

Bore holes 11 each have a first length 11*a* adjacent surface 36 that is smaller in diameter than the remaining length 11*b* thereof, as can be seen. The diameter of each length 11*b* is substantially the same as the diameter of the corresponding bore hole 8 in casing 4 whereby the lengths 11*b* are suitable for accommodating an insulated length of conductor element 3 therein. The diameter of lengths 11*a* is suitable for accommodating therein an uninsulated length of element 3 and this diameter should be approximately the same as the outer diameter of the uninsulated conductor so that the play between the conductor and the hole is minimized. As can be seen in FIGS. 2 and 3, the insulation tubes 10 on the elements 3 in bore holes 8 extend into lengths 11*b* of bore holes 11.

A deformable, resilient, elastic plug 12 of rubber or the like is disposed in bore 6 on surface 36 of plate 9. A plug material having a Shore hardness of 60 has been found to be suitable. As can be seen, plug 12 is of a shape and size to contact substantially the entirety of the inner peripheral surface 6*a* of bore 6 adjacent surface 36 of plate 9. Conductors 3 extend through plug 12 and they should be inserted in a manner such that the material of the plug is in contact therewith after insertion. A preferred method for such insertion is to first insert hollow needle-like cannulas through plug 12, then to draw the uninsulated conductors through the cannulas, and thereafter to withdraw the cannulas from plug 12. The resiliency of the plug 12 causes it to return to its original shape in tightly surrounding and contacting relationship to the conductors 3 when the cannulas are withdrawn.

A plate 13 is preferably disposed in bore 6 on plug 12 as shown in FIGS. 2 and 3. Plate 13 is provided with individual holes 14 for the conductors 3. The conductors 3 extending through holes 14 are preferably insulated with insulation 10.

The illustrated bushing 2 includes an annular sleeve 15 which contacts plate 13 and which may be used as means for forcing the latter and thus plug 12 axially toward plate 9. Since the position of plate 9 is fixed, such axial force exerted on the elastic, deformable, resilient plug 12 causes the latter to be compressed and to tend to expand laterally (or radially of casing 4) and into sealing contact with respect to surface 6*a* and conductor elements 3 extending therethrough. Sleeve 15 is maintained by locking pins 16 in a fixed relationship with respect to casing 4 and in a position such that plug 12 is in compression between plates 9 and 13. Since sealing is accomplished by thus causing plug 12 to expand radially, its original uncompressed diameter may be slightly smaller than the internal diameter of bore 6 whereby installation of the plug is facilitated.

The bushing 2 is sealed in a pressure tight manner in opening 30 in barrier 1 by means of an o-ring 17 supported by a ring 18 on casing 4. O-ring 17 is fixed radially by means of a sleeve 19, a plate 20 and a locking ring 21 as best shown in FIG. 2.

The production of the improved bushing of the present invention is much simpler than the production of prior art bushings. Moreover, installation and service procedures are facilitated thereby since the conductors and internal insulation may conveniently be installed, removed and/or replaced. Moreover, the improved bushing of this invention has been found to be reliable at pressures ranging from 0.01 to 3000 bar.

The insulator plate 9 may, of course, be built up from two or more plates provided with bore holes having different diameters.

I claim:

1. An electrical bushing to facilitate the passage of elongated conductor elements through a pressure barrier comprising:

an elongated bushing casing adapted for longitudinal insertion in an opening extending through a pressure barrier and having shoulder means thereon adapted for abutment against corresponding shoulder means in said opening to thereby establish and fix the positioning of the casing in the opening relative to the barrier, said casing having a centrally disposed bore extending longitudinally therethrough from one end thereof that is intended for placement at the high pressure side of said barrier and terminating in said casing at a point between the ends of the latter thereby presenting a bottom for the bore which normally faces toward said high pressure side of the barrier when the casing is inserted in the opening, said casing also having a plurality of individual bore holes extending longitudinally through the casing from the other end thereof that is intended for placement on the low pressure side of the barrier, through said bottom and into communication with said bore, said bore holes each being of sufficient diameter to accommodate an insulated conductor element therein;

an insulator plate disposed in said bore on said bottom and presenting an upper surface facing in the same direction as said bottom, said plate having a plurality of individual bore holes extending therethrough in a direction longitudinally of the casing from said bottom and through said surface, there being a corresponding bore hole in said plate for each of the bore holes of the casing, said corresponding bore holes of the plate and of the casing being disposed in longtiduinal alignment, said bore holes of the plate each having a first length adjacent said surface which is smaller in diameter than the remaining length thereof, each said remaining length having a diameter which is substantially the same as the diameter of the corresponding bore hole of the casing for accommodating an insulated conductor element therein, said first lengths each having a diameter suitable for accommodating an uninsulated conductor element therein; and a deformable, resilient, elastic plug disposed in said bore on said surface of the plate, said plug being of a shape and size to sealingly contact the inner peripheral surface of said bore adjacent said surface of the plate and being adapted for having uninsulated conductor elements inserted therethrough in a manner such that the material of the plug will be in contact with the uninsulated conductor elements, whereby when said plug is forced toward said plate, the plug tends to expand laterally and into sealing contact with respect to said peripheral surface and the uninsulated conductor elements when extending through the plug.

2. A bushing as set forth in claim 1 wherein is included means for forcing said plug toward said plate.

3. An electrical bushing for facilitating the passage of multiple elongated conductor elements through a hole in a pressure barrier, the hole including a cylindrical zone with a large diameter, a cylindrical zone with a small diameter, and a conical intermediate zone therebetween, said large diameter zone communicating with the high pressure side of said barrier and the small diameter zone communicating with the low pressure side of said barrier, said electrical bushing comprising:

an elongated casing element capable of fitting within said hole in said pressure barrier, said casing including a first cylindrical portion with a large diameter, a second cylindrical portion with a small diameter, and a conical intermediate portion therebetween, said casing being adapted to fit within said hole so as to establish and fix the positioning of the casing relative to said barrier, said casing including a centrally disposed bore extending longitudinally therethrough from a first end thereof on said first cylindrical portion thereof to a bottom portion located in said casing between the ends of the latter, said bottom thus facing toward said first end of said casing, said casing also having a plurality of individual bore holes extending longitudinally through the casing from the second end thereof on said second cylindrical portion through said bottom and into communication with said centrally disposed bore, said bore holes each being of sufficient diameter to acccommodate an insulated conductor element therein;

an insulator plate disposed in said centrally disposed bore on said bottom and presenting an upper surface facing in the same direction as said bottom, said plate having a plurality of individual bore holes extending therethrough in a direction longitudinally of the casing from said bottom and through said surface, there being a corresponding bore hole in said plate for each of the bore holes of the casing, said corresponding bore holes of the plate and of the casing being disposed in longitudinal alignment, said bore holes of the plate each having a first length adjacent said surface which is smaller in diameter than the remaining length thereof, each said remaining length having a diameter which is substantially the same as the diameter of the corresponding bore hole of the casing for accommodating an insulated conductor element therein, said first lengths each having a diameter suitable for accommmodating an uninsulated conductor element therein; and a deformable, resilient, elastic plug disposed in said centrally disposed bore on said surface of the plate, said plug being of a shape and size to sealingly contact the inner peripheral surface of said bore adjacent said surface of the plate and being adapted for having uninsulated conductor elements inserted therethrough in a manner such that the material of the plug will be in contact with the uninsulated conductor elements, whereby when said plug is forced toward said plate, the plug tends to expand laterally and into sealing contact with respect to said peripheral surface and the uninsulated conductor elements when extending through the plug.

* * * * *